US008800765B2

(12) United States Patent
Ting et al.

(10) Patent No.: US 8,800,765 B2
(45) Date of Patent: Aug. 12, 2014

(54) PACKAGING ASSEMBLY

(71) Applicant: Hon Hai Precision Industry Co., Ltd., New Taipei (TW)

(72) Inventors: Yu-Chen Ting, New Taipei (TW); Chih-Hang Chao, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/873,226

(22) Filed: Apr. 30, 2013

(65) Prior Publication Data

US 2014/0054194 A1 Feb. 27, 2014

(30) Foreign Application Priority Data

Aug. 27, 2012 (TW) ..... 101130961 A

(51) Int. Cl.

| | |
|---|---|
| ***B65D 85/30*** | (2006.01) |
| ***B65D 85/48*** | (2006.01) |
| *B65D 81/02* | (2006.01) |
| *B65D 81/05* | (2006.01) |
| *B65D 81/07* | (2006.01) |

(52) U.S. Cl.

CPC ..... *B65D 85/30* (2013.01); *B65D 85/48* (2013.01); *B65D 81/022* (2013.01); *B65D 81/05* (2013.01); *B65D 81/07* (2013.01)

USPC ..... 206/320; 206/592; 206/588; 206/521; 206/454; 206/723; 206/201; 53/396; 53/399; 217/52; 217/53; 217/35

(58) Field of Classification Search

CPC ..... B65D 85/30; B65D 85/48; B65D 81/022; B65D 81/02; B65D 81/05; B65D 81/07; B65D 81/107

USPC ..... 206/320, 592, 593, 586, 523, 453, 451, 206/454, 723, 588, 722, 201, 521; 53/396, 53/399; 217/52, 53, 35

See application file for complete search history.

(56) References Cited

U.S. PATENT DOCUMENTS

| | | | | | |
|---|---|---|---|---|---|
| 1,714,692 | A | * | 5/1929 | Pagel et al. | 206/451 |
| 1,929,161 | A | * | 10/1933 | Coffin et al. | 206/451 |
| 2,281,657 | A | * | 5/1942 | Aquino | 206/454 |
| 2,631,723 | A | * | 3/1953 | Ellsworth | 206/453 |
| 3,081,018 | A | * | 3/1963 | Hall | 206/586 |
| 3,082,896 | A | * | 3/1963 | Mosher | 217/53 |
| 3,181,766 | A | * | 5/1965 | Kane et al. | 206/589 |
| 3,203,726 | A | * | 8/1965 | Smith | 294/74 |
| 3,307,691 | A | * | 3/1967 | Vallebona | 206/451 |
| 3,331,105 | A | * | 7/1967 | Gordon | 24/16 PB |
| 3,344,917 | A | * | 10/1967 | Raffet | 206/451 |
| 3,416,652 | A | * | 12/1968 | Almasy | 206/453 |
| 3,442,735 | A | * | 5/1969 | Stensaker | 156/73.5 |
| 3,524,415 | A | * | 8/1970 | Heiman | 108/53.3 |

(Continued)

*Primary Examiner* — Mickey Yu
*Assistant Examiner* — Gideon Weinerth
(74) *Attorney, Agent, or Firm* — Novak Druce Connolly Bove + Quigg LLP

(57) ABSTRACT

A package assembly includes a package member and a securing member. The package member includes a holding seat configured for holding an electronic device and a plurality of grasping portions extending from the holding seat for grasping the electronic device. The securing member includes an enclosing frame, attached to and surrounding the holding seat, and at least one resisting section, extending from the enclosing frame and adhered to the holding seat, and the securing member made from adhesive tap.

9 Claims, 2 Drawing Sheets

(56) References Cited

U.S. PATENT DOCUMENTS

| | | | | | |
|---|---|---|---|---|---|
| 3,565,243 | A * | 2/1971 | Freeman | 206/523 |
| 3,572,574 | A * | 3/1971 | Mears | 206/521 |
| 3,675,595 | A * | 7/1972 | Sullivan | 108/57.28 |
| 3,695,421 | A * | 10/1972 | Wood | 206/523 |
| 3,709,358 | A * | 1/1973 | Andrews et al. | 206/451 |
| 3,720,035 | A * | 3/1973 | Rutter | 3/399 |
| 3,841,477 | A * | 10/1974 | Stark et al. | 206/557 |
| 3,912,076 | A * | 10/1975 | Elwell | 206/320 |
| 3,930,578 | A * | 1/1976 | Stein | 206/150 |
| 3,938,661 | A * | 2/1976 | Carmody | 206/523 |
| 3,949,932 | A * | 4/1976 | Shore | 229/103.2 |
| 3,963,166 | A * | 6/1976 | Skimming | 206/588 |
| 4,011,632 | A * | 3/1977 | MacDonald | 410/99 |
| 4,072,230 | A * | 2/1978 | Mulligan | 206/722 |
| 4,122,946 | A * | 10/1978 | Holley | 206/523 |
| 4,158,410 | A * | 6/1979 | Novatny | 206/527 |
| 4,162,729 | A * | 7/1979 | Kaiser et al. | 206/592 |
| 4,382,511 | A * | 5/1983 | Hamelin et al. | 206/427 |
| 4,533,052 | A * | 8/1985 | Fruchey et al. | 229/120.011 |
| 4,759,446 | A * | 7/1988 | Dobashi et al. | 206/586 |
| 4,817,797 | A * | 4/1989 | Hamelin | 206/428 |
| 4,865,200 | A * | 9/1989 | Sullivan et al. | 206/583 |
| 5,058,745 | A * | 10/1991 | Warner et al. | 206/523 |
| 5,207,327 | A * | 5/1993 | Brondos | 206/523 |
| 5,215,195 | A * | 6/1993 | Williams | 206/446 |
| 5,465,838 | A * | 11/1995 | Hollander et al. | 206/305 |
| 5,515,976 | A * | 5/1996 | Moren et al. | 206/586 |
| 5,573,114 | A * | 11/1996 | Cyr | 206/316.1 |
| 5,665,409 | A * | 9/1997 | Drewry | 426/132 |
| 5,678,691 | A * | 10/1997 | Amado-Aguilar et al. | 206/451 |
| 5,682,997 | A * | 11/1997 | Bartholomew | 206/451 |
| 5,755,331 | A * | 5/1998 | Watson | 206/586 |
| 5,772,025 | A * | 6/1998 | Chen et al. | 206/320 |
| 5,803,257 | A * | 9/1998 | Bartholomew | 206/454 |
| 5,813,536 | A * | 9/1998 | Bartholomew | 206/449 |
| 5,909,808 | A * | 6/1999 | Bartholomew | 206/451 |
| 5,988,390 | A * | 11/1999 | McCoy | 206/596 |
| 6,216,607 | B1 * | 4/2001 | Cuddy | 108/55.5 |
| 6,382,422 | B1 * | 5/2002 | Bocek | 206/586 |
| 6,622,860 | B2 * | 9/2003 | Horbal | 206/320 |
| 6,695,140 | B2 * | 2/2004 | Manuel | 206/320 |
| 6,817,161 | B1 * | 11/2004 | Wu et al. | 53/449 |
| 6,938,773 | B1 * | 9/2005 | Sotto | 206/523 |
| 6,976,587 | B2 * | 12/2005 | Liverman et al. | 206/586 |
| 7,210,579 | B2 * | 5/2007 | Fujioka et al. | 206/451 |
| 7,341,151 | B2 * | 3/2008 | Takagi | 206/454 |
| 7,419,055 | B2 * | 9/2008 | Manuel | 206/523 |
| 7,559,425 | B2 * | 7/2009 | Hsu et al. | 206/576 |
| 7,578,390 | B2 * | 8/2009 | Ting | 206/454 |
| 7,604,120 | B2 * | 10/2009 | Ting et al. | 206/454 |
| 7,658,285 | B2 * | 2/2010 | Hagan et al. | 206/448 |
| 7,988,517 | B2 * | 8/2011 | Bishop | 446/85 |
| 8,061,521 | B1 * | 11/2011 | Lowry et al. | 206/576 |
| 8,215,484 | B2 * | 7/2012 | Lim | 206/320 |
| 8,272,514 | B2 * | 9/2012 | Zeng et al. | 206/586 |
| 8,474,614 | B2 * | 7/2013 | Hanson et al. | 206/320 |
| 2005/0103670 | A1 * | 5/2005 | Fujioka et al. | 206/454 |
| 2005/0155890 | A1 * | 7/2005 | Manuel | 206/523 |
| 2005/0161366 | A1 * | 7/2005 | Kobashi et al. | 206/586 |
| 2005/0178690 | A1 * | 8/2005 | Sotto | 206/523 |
| 2005/0241979 | A1 * | 11/2005 | Manuel et al. | 206/523 |
| 2006/0219596 | A1 * | 10/2006 | Lin et al. | 206/592 |
| 2007/0039848 | A1 * | 2/2007 | Burchell | 206/453 |
| 2007/0187283 | A1 * | 8/2007 | Otsuka et al. | 206/576 |
| 2008/0053866 | A1 * | 3/2008 | Cheng et al. | 206/592 |
| 2009/0050511 | A1 * | 2/2009 | Xie et al. | 206/523 |
| 2011/0017616 | A1 * | 1/2011 | Thomas et al. | 206/216 |
| 2011/0049000 | A1 * | 3/2011 | Ishibashi | 206/521 |
| 2012/0241351 | A1 * | 9/2012 | Tsukii | 206/521 |
| 2013/0233754 | A1 * | 9/2013 | Liu | 206/521 |
| 2013/0277253 | A1 * | 10/2013 | Hanson et al. | 206/320 |
| 2014/0034532 | A1 * | 2/2014 | Aoyama | 206/389 |

* cited by examiner

PACKAGING ASSEMBLY

BACKGROUND

1. Technical Field

The present disclosure relates to a packaging assembly.

2. Description of Related Art

A package assembly includes at least one foam, made from expanded polyethylene or extruded polyethylene material, and a paper box, configured to accommodate an electronic device and the foam. However, the foam sometimes cannot securely grasp the electronic device. The electronic device is still easily to be damaged when it is dropped or suffers from impact.

Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
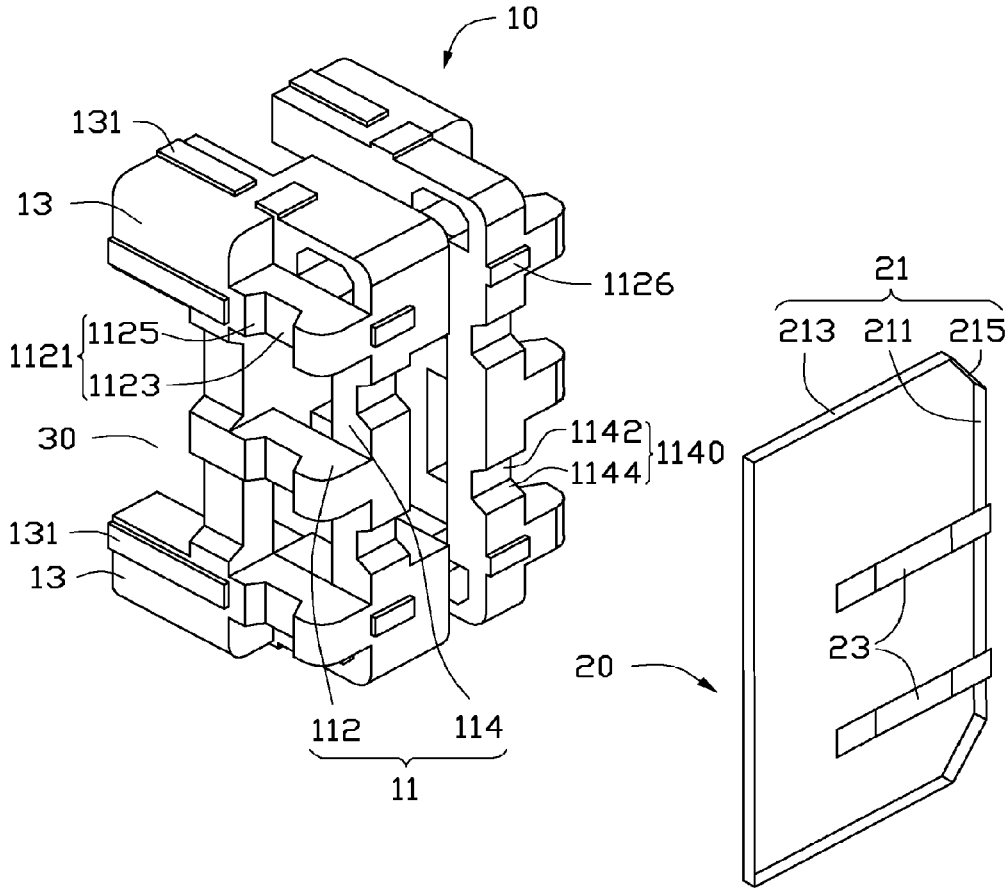
FIG. 1 is an exploded, isometric view of a packaging assembly in accordance with an embodiment.

FIG. 1 shows an embodiment of a package assembly. The package assembly includes a package member 10 and a securing member 20. In one embodiment, the package member 10 is used for packaging an electronic device, such as a computer host. The securing member 20 is made from adhesive tape.

In one embodiment, a main portion of the package member 10 is made from expanded polyethylene material. The package member 10 includes a holding seat 11 and a grasping portion 13 protruding from each of four corners of the holding seat 11. An accommodating space 30 is formed between the holding seat 11 and the grasping portion 13.

The holding seat 11 includes two vertical resisting portions 114 and a plurality of connecting portions 112 perpendicularly connected to each of the two vertical resisting portions 114. A first groove 1121 is defined in each of the plurality of connecting portions 112. The first groove 1121 includes a first base surface 1123 and a first slanting surface 1125 connecting with the first base surface 1123. A first angle between the first base surface 1123 and the first slanting surface is not less than 90 degrees but less than 180 degrees. A plurality of reinforced ribs 1126 protrudes from the two vertical resisting portions 114. A pair of second grooves 1140 is defined in each of the two vertical resisting portions 114. Each pair of second grooves 1140 includes a second base surface 1142 and a second slanting surface 1144 connecting with the second base surface 1142. A second angle between the second base surface 1142 and the second slanting surface 1144 is not less than 90 degrees but less than 180 degrees. The first base surface 1123 is substantially perpendicular to the second base surface 1142.

At least one second reinforced rib 131 is attached to and protrudes from an exterior surface of the grasping portion 13. In one embodiment, the at least one second reinforced rib 131 is made from extruded polyethylene material.

The securing member 20 includes an enclosing frame 21 and a pair of resisting sections 23 extending from the enclosing frame 21. The enclosing frame 21 includes a vertical section 211, a pair of horizontal sections 213 substantially perpendicular to the vertical section 211, and a pair of slanting connecting sections 215 connected to two ends of the vertical section 211 and the pair of horizontal sections 213. The pair of resisting sections 23 is connected to and substantially perpendicular to the vertical section 211.

Figure 2:
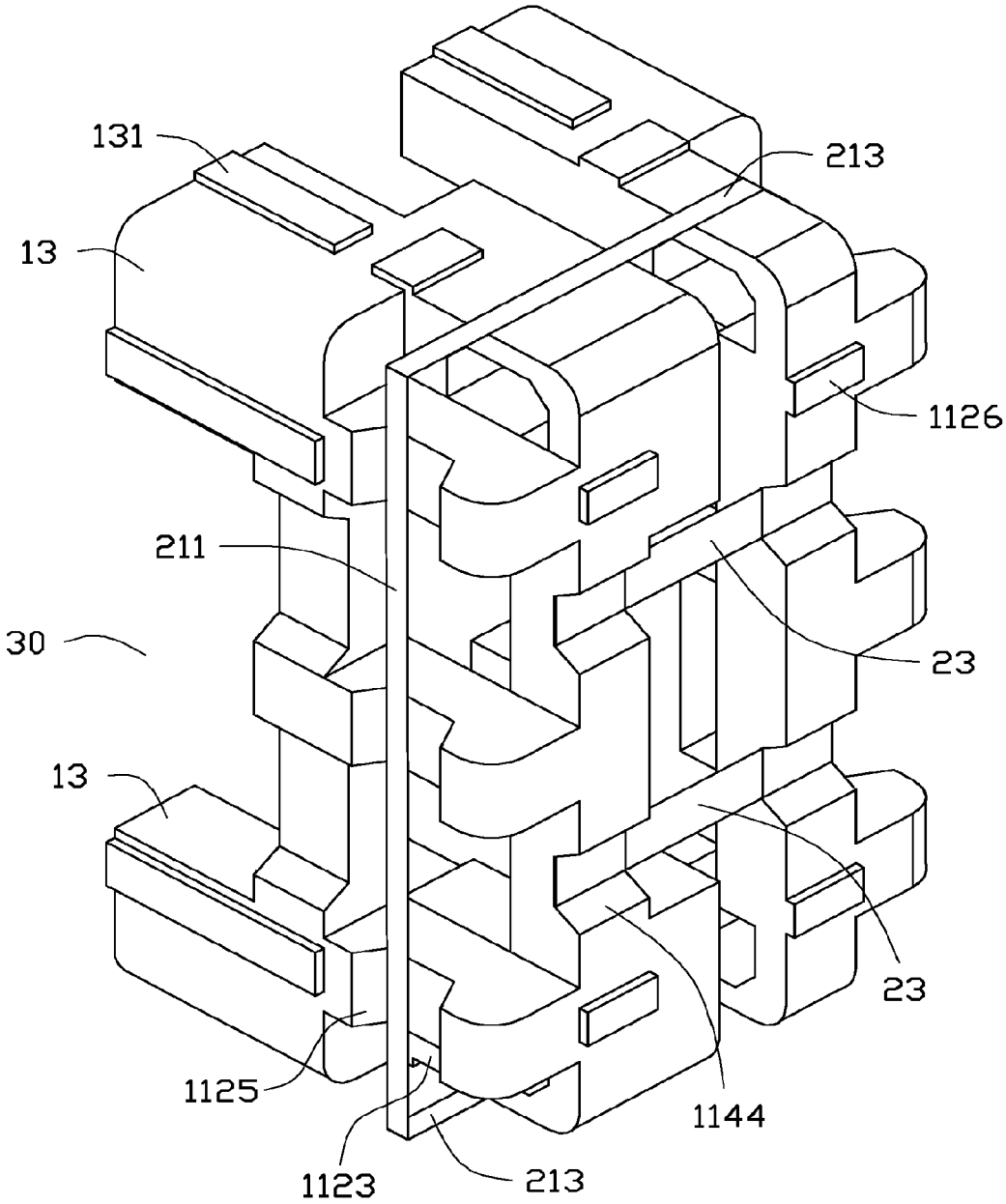
FIG. 2 is an assembled view of the packing assembly of FIG. 1.

FIG. 2 shows that in assembly, the enclosing frame 21 is adhered to and surrounds the holding seat 11. The vertical section 211 is located in the first groove 1121 and adhered to the first base surface 1123. Each of the pair of resisting sections 23 is located in the second groove 1140 and adhered to the second base surface 1142. In one embodiment, the vertical section 211 abuts the first slanting surface 1125. Each of the pair of resisting sections 23 abuts the second slanting surface 1144.

In use, the electronic device is placed in the accommodating space 30 formed by the package member 10. The grasping portion 13 grasps the electronic device. The securing member 20 helps the package member 10 to securely grasp the electronic device in the accommodating space 30.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A package assembly comprising:

a package member comprising a holding seat, configured for holding an electronic device, and a plurality of grasping portions extending from the holding seat for grasping the electronic device;

and a securing member comprising an enclosing frame, attached to and surrounding the holding seat, and at least one resisting section extending from the enclosing frame and adhered to the holding seat, and the securing member comprises an adhesive tape;

wherein the enclosing frame comprises a first section, a pair of second sections substantially perpendicular to the first section, and a pair of slanting connecting sections connected between the first section and the pair of second sections; and the at least one resisting section is connected to and substantially perpendicular to the first section.

2. The package assembly of claim 1, wherein the plurality of grasping portions protrudes from four corners of the holding seat, and an accommodating space is formed between the holding seat and the plurality of grasping portions, for accommodating the electronic device.

3. The package assembly of claim 2, wherein the holding seat comprises two resisting portions and a plurality of connecting portions perpendicularly connected to each of the two resisting portions, and the resisting section is attached to the two resisting portions and the plurality of connecting portions.

4. The package assembly of claim 3, wherein a first groove is defined in each of the plurality of connecting portions, at least one second groove is defined in each of the two resisting portions, and the securing member is located in the first groove and the at least one second groove.

5. The package assembly of claim 4, wherein the first section is located in the first groove, and the at least one resisting section is located in the at least one second groove.

6. The package assembly of claim 5, wherein the first groove comprises a first base surface and a first slanting surface connected to the first base surface, and the first section is adhered to the first base surface and abuts the first slanting surface.

7. The package assembly of claim 6, wherein the at least one second groove comprises a second base surface and a second slanting surface connected to the second base surface, the at least one resisting section is adhered to the second base surface and abuts the second slanting surface.

8. The package assembly of claim 7, wherein a first reinforced rib protrudes from each of the two resisting portions, and a second reinforced rib is attached to and protrudes from each of the plurality of grasping portions.

9. The package assembly of claim 8, wherein a main portion of the package member comprises expanded polyethylene material, and the second reinforced rib comprises extruded polyethylene material.

* * * * *